US005645409A

United States Patent [19]

Ni et al.

[11] Patent Number: 5,645,409

[45] Date of Patent: Jul. 8, 1997

[54] SLOTTED BURNER FOR GAS FIREPLACE

[75] Inventors: Li Ni; Robert A. Borgeson, both of Cleveland; Nick M. Kules, Parma; John Schmidt, Brunswick, all of Ohio

[73] Assignee: Gas Research Institute, Chicago, Ill.

[21] Appl. No.: 609,066

[22] Filed: Feb. 29, 1996

[51] Int. Cl.[6] ..... F23D 14/46

[52] U.S. Cl. ..... 431/8; 431/125; 431/354; 431/326; 126/512

[58] Field of Search ..... 431/354, 350, 431/8, 125, 346, 328, 326; 126/512

[56] References Cited

U.S. PATENT DOCUMENTS

| | | | |
|---|---|---|---|
| 153,389 | 7/1874 | Smith et al. . | |
| 457,081 | 8/1891 | Grant . | |
| 587,334 | 8/1897 | Sharpe . | |
| 659,553 | 10/1900 | Sharpe . | |
| 3,177,923 | 4/1965 | Hine et al. | 431/346 |
| 3,285,317 | 11/1966 | Hine et al. | 431/346 |
| 3,382,861 | 5/1968 | Peterson . | |
| 3,434,668 | 3/1969 | Boling . | |
| 4,061,133 | 12/1977 | Swain . | |
| 4,346,845 | 8/1982 | Meyerhoff et al. . | |
| 4,418,456 | 12/1983 | Riehl | 431/354 |
| 4,694,818 | 9/1987 | Bridgwater . | |
| 4,838,240 | 6/1989 | Rieger . | |
| 4,883,043 | 11/1989 | Thow et al. . | |
| 4,886,445 | 12/1989 | Richardson . | |
| 4,930,490 | 6/1990 | Allan . | |
| 4,971,031 | 11/1990 | Richardson . | |
| 5,000,162 | 3/1991 | Shimek et al. . | |
| 5,057,007 | 10/1991 | Andringa et al. . | |
| 5,059,115 | 10/1991 | Sutton . | |
| 5,081,981 | 1/1992 | Beal . | |
| 5,092,313 | 3/1992 | Blackburn et al. . | |
| 5,133,657 | 7/1992 | Harris | 431/326 |
| 5,139,011 | 8/1992 | Moon . | |
| 5,215,457 | 6/1993 | Sebastiani | 431/326 |
| 5,320,520 | 6/1994 | Barth et al. . | |
| 5,344,312 | 9/1994 | Polidero | 431/326 |

OTHER PUBLICATIONS

F.G. Roper, C. Smith, and A.C. Cuningham, "The Prediction of Laminar Jet Diffusion Flame Sizes: Part II. Experimental Verification"; Combustion and Flame, vol. 29, pp. 227–234 (1977).

"Development of an Advanced Gas Fireplace", Progress Report—Aug. 1994 to Jan. 1995; by Robert A. Borgeson, Vera Kam, and Li Ni, American Gas Association Laboratories; Mar. 31, 1995.

Research in Fundamentals of Atmospheric Gas Burner Design, Research Bulletin 10; American Gas Association Testing Laboratories, Cleveland, Ohio (Mar., 1940).

*Primary Examiner*—Carl D. Price

*Attorney, Agent, or Firm*—Speckman, Pauley & Fejer

[57] ABSTRACT

A method and apparatus for producing a gas-fired flame which simulates a wood-burning flame. The apparatus includes an elongated slot which is port loaded to produce a buoyancy controlled flame which flickers and closely resembles a wood-burning flame.

13 Claims, 6 Drawing Sheets

SLOTTED BURNER FOR GAS FIREPLACE

BACKGROUND OF THE INVENTION

1. Field of the Invention

This invention relates to gas-fired fireplaces and other hearth products and provides a method and apparatus for achieving a yellow, aesthetically-pleasing and realistic flame which closely simulates a wood-burning flame, and which produces low carbon monoxide emissions.

2. Description of Prior Art

Gas fireplaces are becoming increasingly popular in both new home construction and in retrofitting wood-burning fireplaces in existing homes. Popularity of gas fireplaces over traditional wood-burning fireplaces is driven by several factors. Some states and localities have introduced legislation limiting wood-burning fireplaces because of the pollutants generated by burning wood. Wood can also be relatively expensive in some localities, and consumers often merely do not want the inconvenience of storing and transporting wood for a fireplace.

Traditionally, however, gas-fired fireplaces, for example those using natural gas or propane, have not been successful at simulating the appearance of a natural wood-burning flame. Because the velocity and flow rate of gas used in such gas-fired fireplaces remains relatively stable, flames generated by the gas also remain relatively stable and unchanging in appearance, unlike the flickering and rapidly changing flame associated with a wood-burning fire.

Attempts have been made to simulate the appearance of wood-burning fires with gas-fired burners.

U.S. Pat. No. 5,092,313 discloses a gas log fireplace which achieves a high heat output and highly efficient combustion. The fireplace includes a plurality of vertical gas ports and a fibbed heat exchanger positioned above a firebox which enhances heat transfer into the surrounding environment.

U.S. Pat. No. 4,886,445 teaches a gas burning artificial log assembly which includes a burner pan and a burner manifold which form adjustable elongated exit slots that are aligned parallel to artificial logs.

U.S. Pat. No. 4,838,240 discloses a gas burner assembly which includes a gas distribution tile having a plurality of vertical holes which form a honeycomb-like pattern.

U.S. Pat. No. 5,000,162 discloses a gas burner system having decorative gas logs. The burner system includes a plurality of nozzles for producing flames between the logs.

U.S. Pat. No. 4,883,043 discloses a gas-fired fireplace assembly having a plurality of nozzles positioned between artificial logs. The '043 patent indicates that the nozzles are capable of generating yellow flames which simulate a wood-burning fire.

U.S. Pat. No. 4,930,490 discloses a gas log apparatus which includes a ported chamber. The ports are rectangular, and are formed at the apex of a v-shaped ridge. The ports have sharply angled comers. The sharp vertices provide turbulence which the '490 patent indicates produces a ragged yellow and luminous flame.

U.S. Pat. No. 5,081,981 discloses a gas fireplace burner assembly which includes a burner tube that provides a plurality of separate yellow flames of different heights and widths between artificial logs of the assembly.

U.S. Pat. No. 5,320,520 discloses a gas burner assembly for simulating a wood-burning fire. The assembly includes two v-shaped grooves having a plurality of slots in the apex of the groove. Fuel is discharged through the slots and a flow of secondary air is directed into the flames to enhance flickering to simulate a wood-burning fire.

U.S. Pat. No. 5,139,011 discloses an unvented gas-fired heater assembly. A duct assembly directs heated air from the heater assembly into a room.

U.S. Pat. Nos. 4,971,031 and 3,382,861 disclose gas-fired burners which include a plurality of slotted ports through which a combustible gas flows.

SUMMARY OF THE INVENTION

It is one object of this invention to provide a method of combustion which achieves a gas-fired yellow flickering flame which simulates the appearance of a natural wood-burning flame.

It is another object of this invention to provide a method of combustion which achieves a flame having a natural wood-burning appearance and produces relatively low carbon monoxide.

It is yet another object of this invention to provide a gas burner which can be used alone or can be integral with a simulated log to produce a flame having a natural wood-burning appearance.

These and other objects of this invention are achieved with a method which includes, according to one preferred embodiment of this invention, introducing a fuel, such as natural gas or propane, into a burner manifold having at least one elongated port at a rate of about 5,000 BTUH to about 30,000 BTUH per square inch of port area. The at least one elongated port has a length-to-width aspect ratio greater than about 10 to 1. According to one preferred embodiment of this invention, the length-to-width aspect ratio exceeds about 100 to 1. From about 0 to about 30 percent by volume of primary air is introduced into the burner manifold. The flame achieved with the method according to this invention produces relatively little carbon monoxide (less than 200 ppm corrected to 0% $O_2$ in the flue gas), and a yellow flickering flame which realistically simulates a wood-burning flame.

According to another preferred embodiment of this invention, the gaseous fuel is introduced into a burner manifold having a plurality of elongated ports. The elongated ports form at least two parallel rows of elongated ports, and the rows are spaced about one inch from each other. The elongated ports of one row can be in a staggered relationship with the elongated ports of an adjacent row. The multiple rows and relatively close proximity of one row to an adjacent row achieves a novel gas-fired three-dimensional flame appearance which contributes to an overall natural wood-burning appearance.

The gas burner according to this invention can be constructed as a nondecorative manifold whose appearance is hidden by simulated wood logs, or can be constructed as an integral part of a simulated wood log.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Although the relevant parameters of the method according to this invention are referred throughout the specification and claims in certain dimensional units such as BTUH and inches, one aspect of this invention can also be described with reference to a nondimensional number commonly referred to as the Froude Number. The Froude Number is identified as $$Fr = \frac{V^2}{gL}$$

where Fr is the Froude Number, V is the gas/air mixture exit velocity from the slotted ports in feet per second, g is the gravitational constant 32.2 ft/s$^2$, and L is the hydraulic diameter of the slot in feet. The Froude Number is used to describe the ratio of the kinetic forces (momentum) to the gravity forces (buoyancy). When the Froude Number is equal to 1, the momentum forces in the fuel/air mixture jet are equal to the buoyancy forces. We have discovered that a burner operating under parameters equivalent to a Froude Number between 0.05 and 4.0 achieves a buoyancy controlled yellow flickering flame which closely simulates the appearance of a natural woodburning flame. The different design parameters can be incorporated into the compact form of Froude Number, which is a design criteria for a yellow flame burner.

Figure 3:
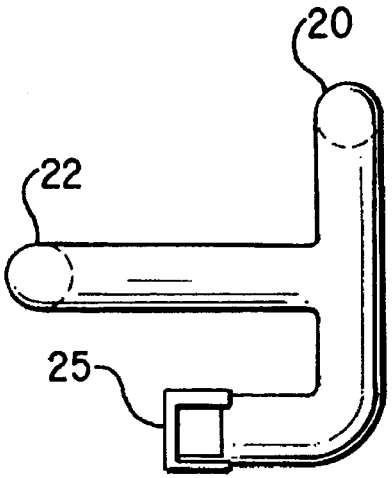
FIG. 3 shows a side view of the burner manifold shown in FIG. 1.
Figure 1:
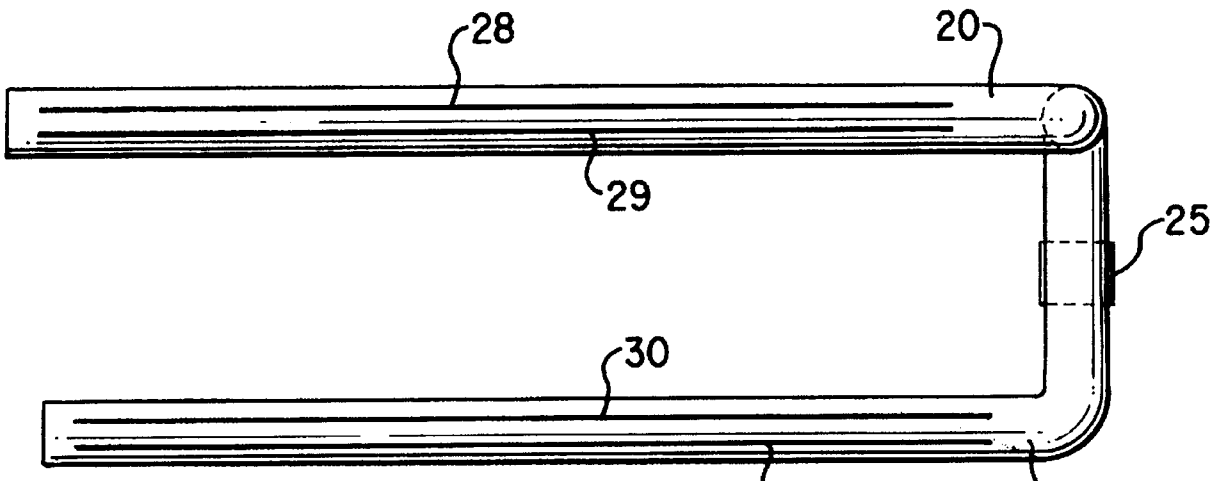
FIG. 1 shows a top view of a burner manifold according to one preferred embodiment of this invention.
Figure 2:
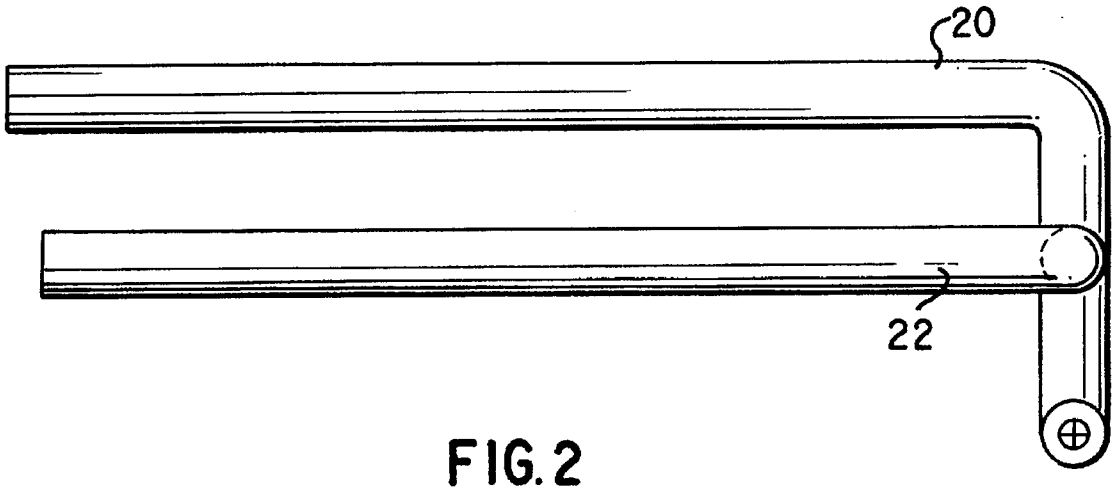
FIG. 2 shows a front view of the burner manifold shown in FIG. 1.

FIGS. 1–3 show top, front and side views, respectively, of a burner 18 according to one preferred embodiment of this invention. For the sake of clarity, the burner is shown as having a primarily cylindrical shape, however the burner according to this invention could be designed to have other suitable shapes, such as rectangular, or could even be shaped as a simulated wood-burning log.

Rear pipe 20 contains elongated slot 28 and elongated slot 29. According to one preferred embodiment of this invention as shown in FIG. 1, elongated slots 28, 29 are 0.04 inches wide and 15 inches long, for an aspect ratio of 375:1. However, the burner according to this invention can have as small an aspect ratio as about 10:1. Slot widths can range from about 1/64" to about 9/64".

The port loading of burner 18 according to this invention is in the range of about 5,000 BTUH/in$^2$ to about 30,000 BTUH/in$^2$. According to one preferred embodiment of this invention the port loading is in the range of about 15,000 BTUH/in$^2$ to about 25,000 BTUH/in$^2$. Burner 18 achieves an aesthetically pleasing yellow dancing flame with carbon monoxide emissions below 200 ppm with a volume of primary air between about 0% and about 30% of the total volume of air required for stoichiometric combustion of the fuel.

While conventional gas-fired burners fire a diffusion flame vertically upward, resulting in a substantially uniform flame pattern, the method and apparatus according to this invention operates to produce a buoyancy controlled flame that rises primarily because of temperature rather than because of the momentum of the fuel.

Figure 4:
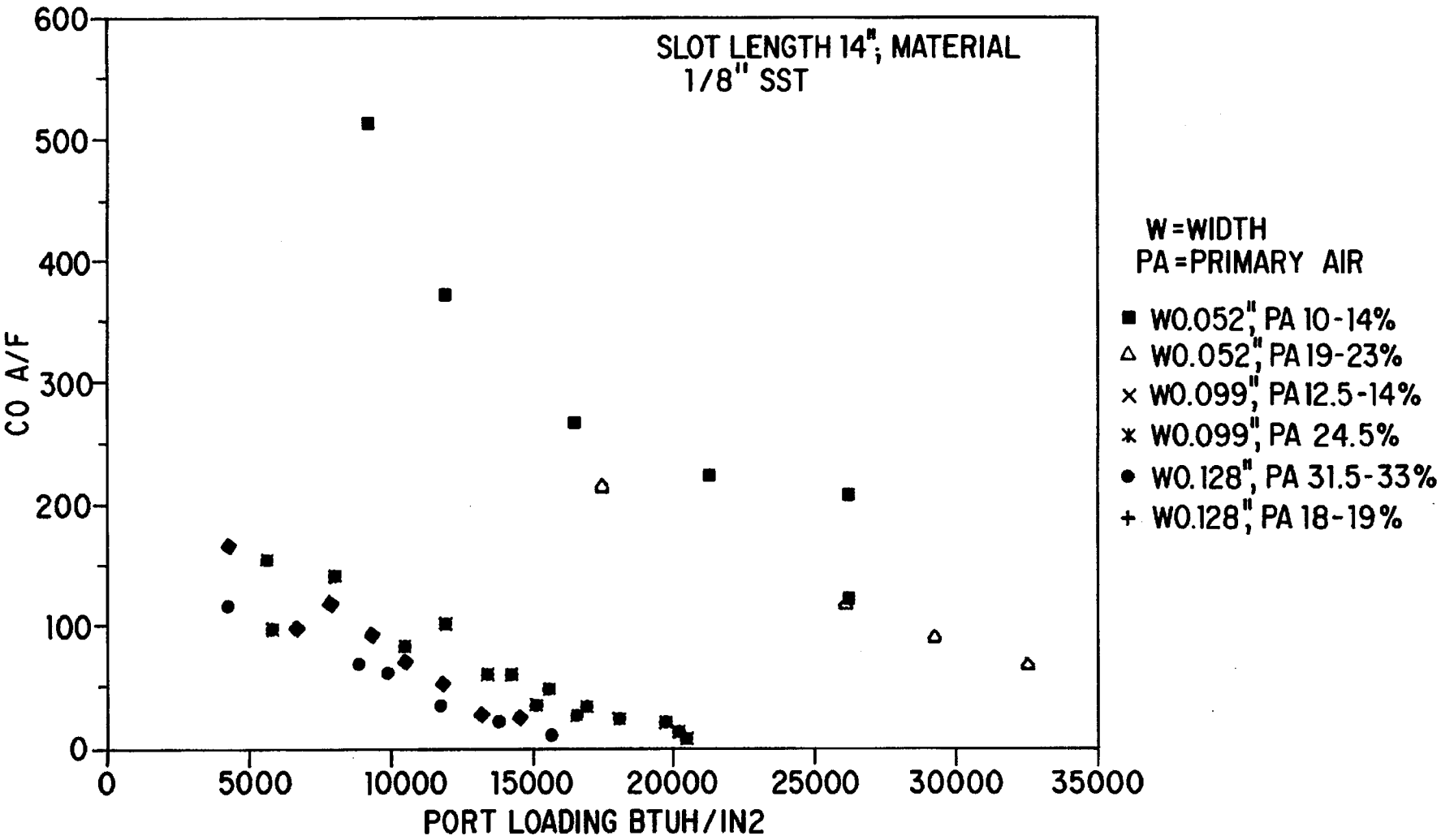
FIG. 4 is a graph showing the effect of port loading, slot widths and volume percentages of primary air to theoretically required combustion air on carbon monoxide emissions.

FIG. 4 is a graph with y-axis values of carbon monoxide emissions and x-axis values of port loading in BTUH/in$^2$ for a burner with a single slot. The length of the slot is 14 inches. FIG. 4 shows various plots representing slot widths from 0.052" to 0.128" with volume percentages of primary air varying from 10% to 33%. FIG. 4 shows how port loading, slot width and the ratio of primary air to fuel affects carbon monoxide emissions.

Figure 5:
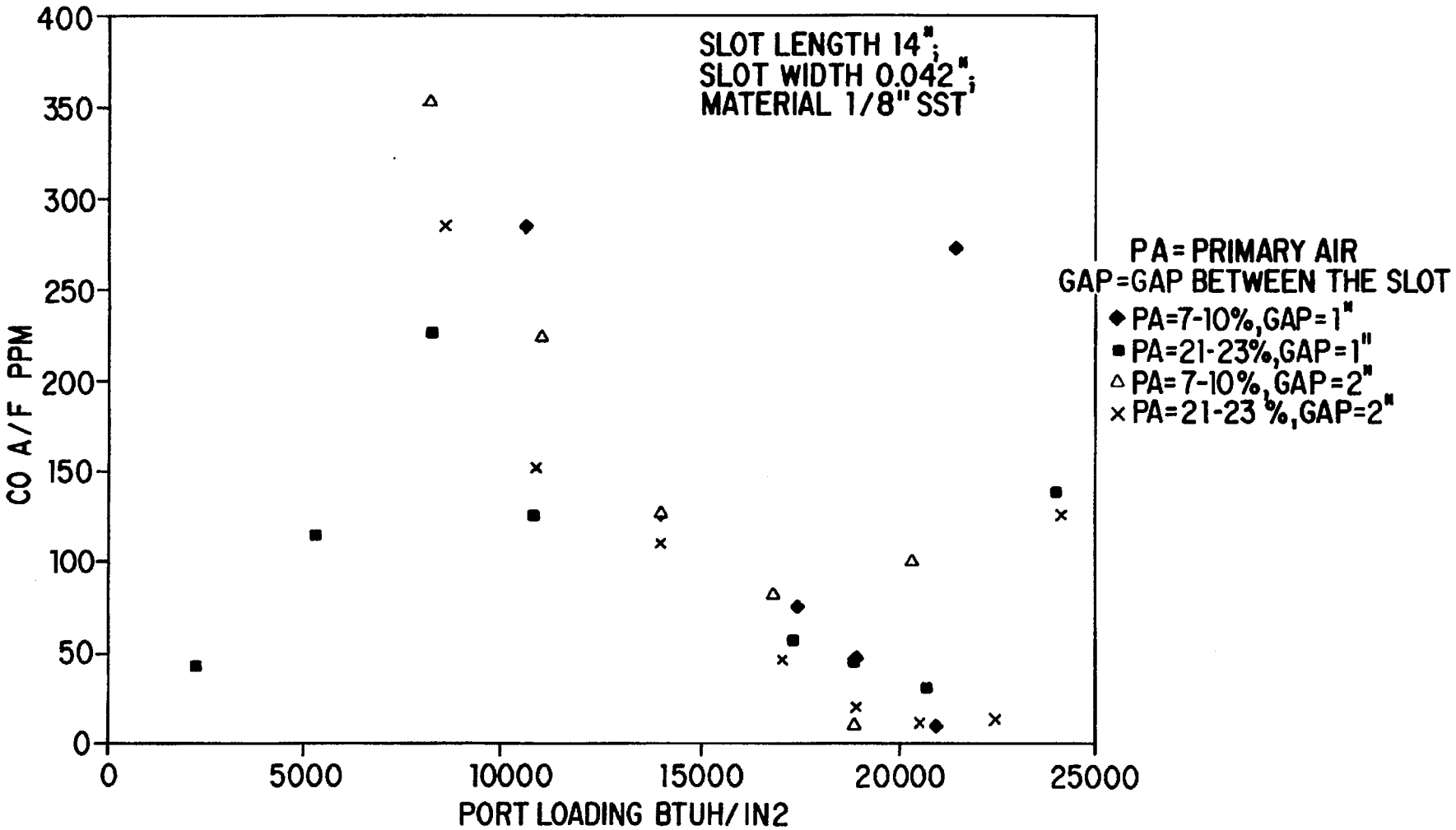
FIG. 5 is a graph showing the effect of multiple slots, volume percentages of primary air to theoretically required combustion air, and the distance between slots on carbon monoxide emissions.

FIG. 5 is a graph with y-axis values of carbon monoxide emissions and x-axis values of port loading in BTUH/in$^2$ for a burner having two slots. Each slot is 14" long and 0.042" wide. The graph shows how carbon monoxide emissions are affected by varying the volume percentages of primary air, the gap between the two slots, and the port loading.

Figure 6:
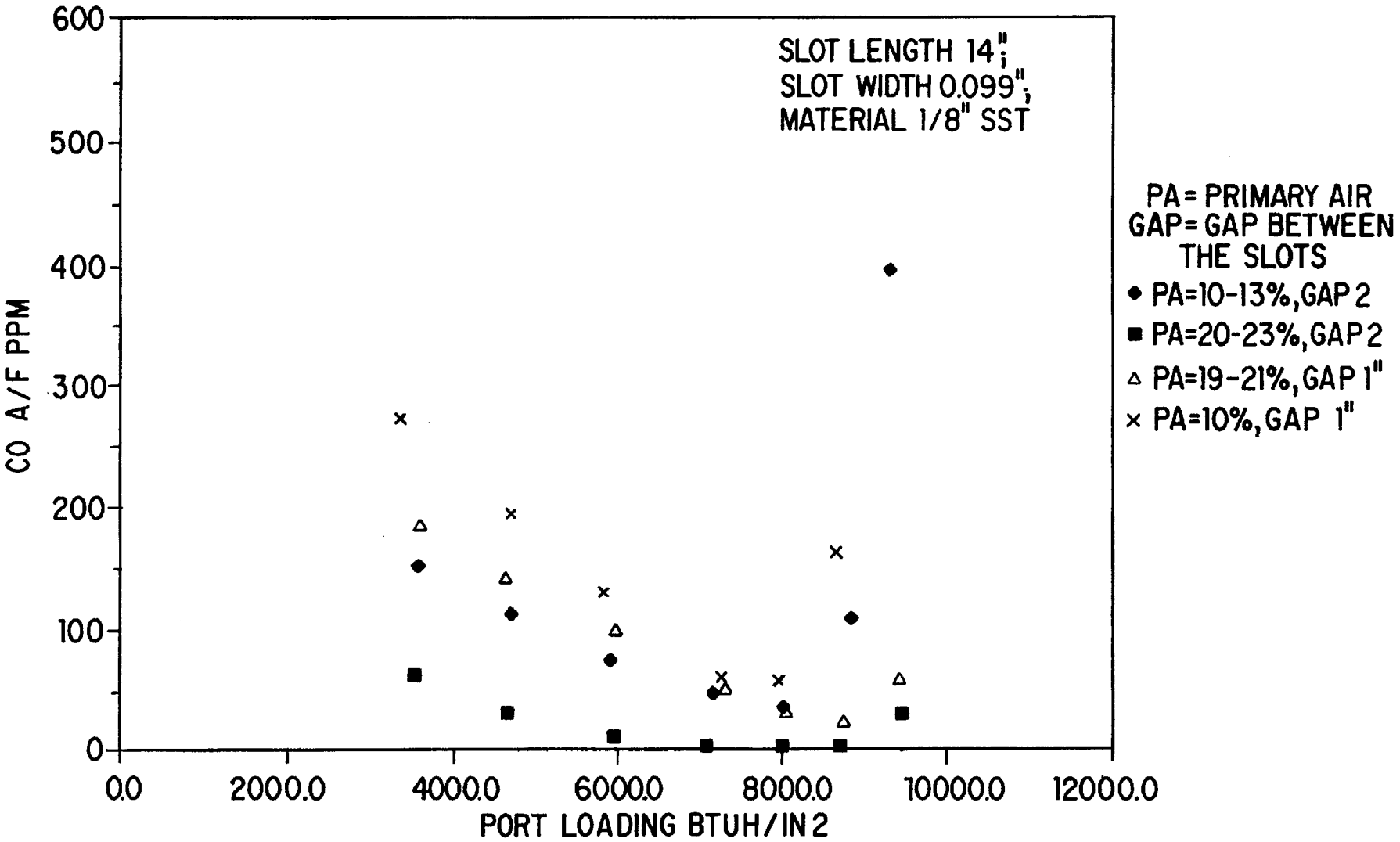
FIG. 6 is a graph showing the effect of port loading, volume percentages of primary air to theoretically required combustion air, and the gap between slots on carbon monoxide emissions.

FIG. 6 is graph with y-axis values of carbon monoxide emissions and x-axis values of port loading in BTUH/in$^2$ for a burner having two slots. Each slot is 14" long and 0.099" wide. The graph shows how carbon monoxide emissions are affected by varying the volume percentages of primary air, the gap between the two slots, and the port loading.

Figure 7:
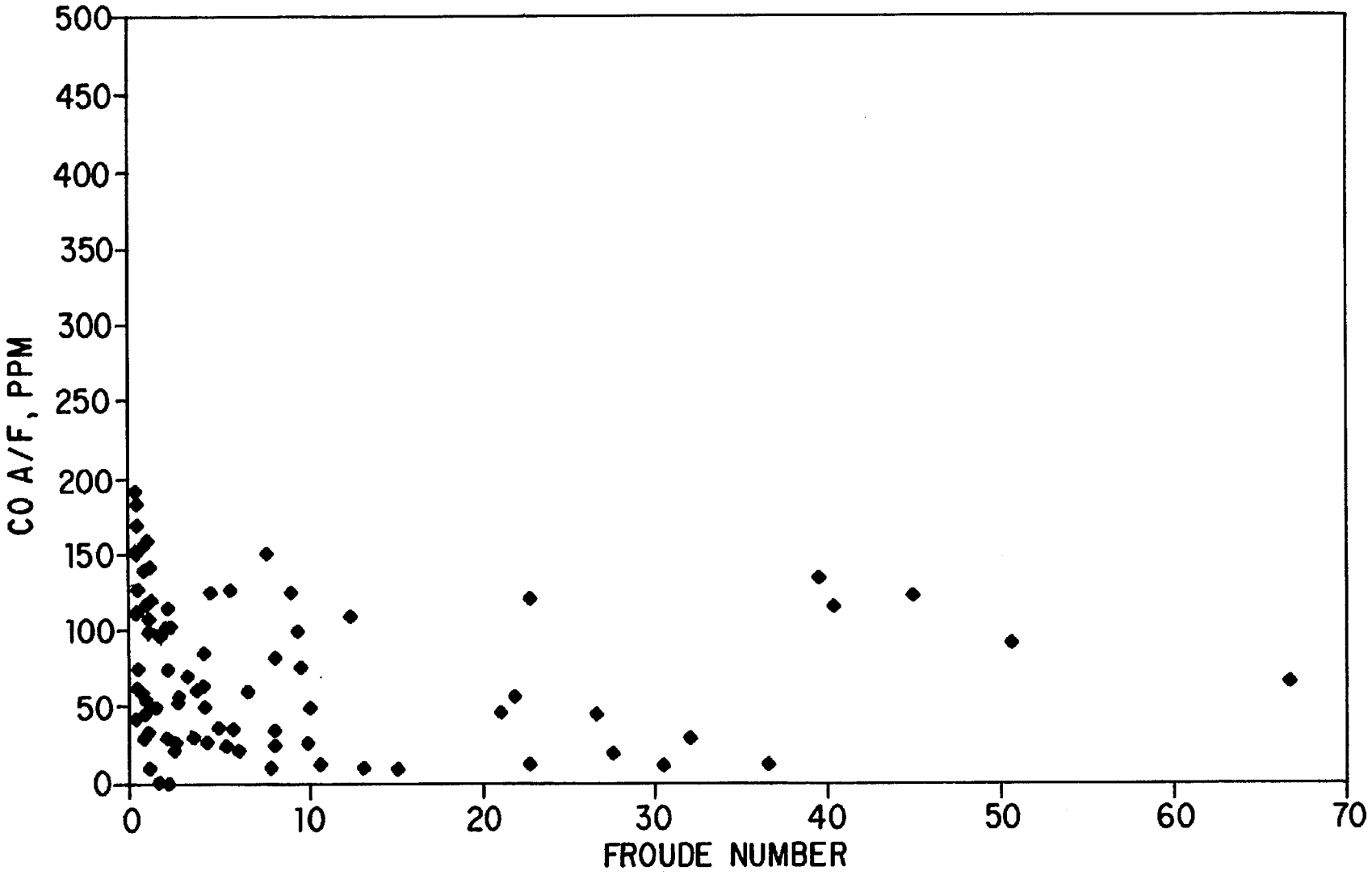
FIG. 7 is a graph showing carbon monoxide emissions associated with certain Froude Numbers.

FIG. 7 is a graph with y-axis values of carbon monoxide emissions and x-axis values of Froude Numbers.

Figure 8:
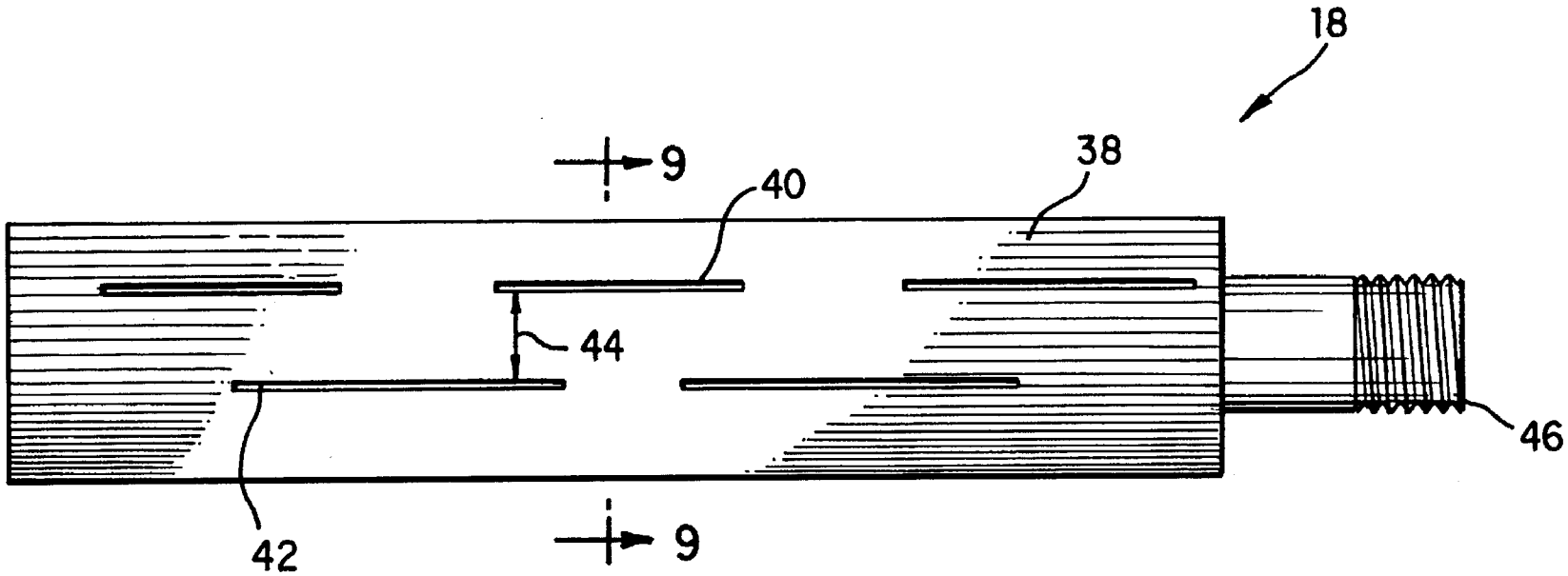
FIG. 8 shows a burner manifold according to another preferred embodiment of this invention.

FIG. 8 shows another preferred embodiment according to this invention. Burner 18 has top face 38 with a plurality of staggered slots 40, 42. Fuel and primary air are fed to burner 18 through nipple 46. A distance 44 between the upper slot row which includes slot 40 and the bottom slot row which includes slot 42 is in the range of about 0.25" to about 1", and is preferably about 0.5". The staggered slots create a novel three-dimensional appearance to the flame which closely simulates the appearance of a natural wood-burning flame.

Figure 9:
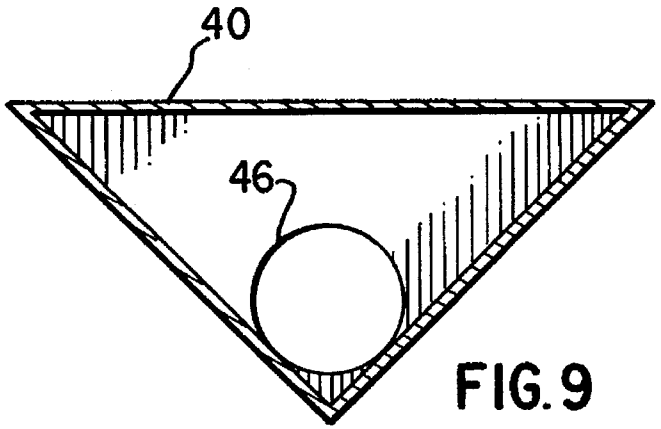
FIG. 9 is a cross-sectional view taken along line 9—9 of FIG. 8.

FIG. 9 is a cross-sectional view taken along line 9—9 of FIG. 8. Although burner 18 has a triangular cross section, it is understood that burner 18 could have any suitable cross section, including round or rectangular. The three dimensional effect achieved by the staggering and spacing of the slots with respect to each other helps achieve the appearance of a natural wood-burning flame.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A method of combustion comprising the steps of:

introducing a fuel into a burner manifold having at least one elongated port at a rate of about 5,000 BTUH to about 30,000 BTUH per square inch of port area, the at least one elongated port having a length to width aspect ratio greater than about 10 to 1;

introducing from about 0 to about 30 percent by volume of combustion air into the burner manifold, producing a fuel/air mixture; and combusting said fuel/air mixture passing through the at least one elongated port, said fuel/air mixture leaving said at least one elongated port having a Froude Number in the range of about 0.05 to 4.0.

2. A method according to claim 1 wherein the enclosure has a plurality of elongated ports.

3. A method according to claim 2 wherein the plurality of elongated ports form a plurality of rows of elongated ports, and the elongated ports in a respective row are positioned generally end-to-end.

4. A method according to claim 3 wherein the plurality of rows are generally parallel with respect to each other.

5. A method according to claim 4 wherein one of the plurality of rows is positioned at a distance of less than about 1 inch from another of the plurality of rows.

6. A method according to claim 4 wherein the elongated slots of one of the rows is in a staggered relationship with the elongated slots of an adjacent row.

7. A method according to claim 1 wherein from about 5 percent to about 20 percent by volume of combustion air is introduced into the burner manifold.

8. A method according to claim 1 wherein the at least one elongated port has a width of about 0.005 inches to about 0.15 inches.

9. A gaseous fuel fireplace burner comprising:

a burner manifold having at least one elongated port having a length to width aspect ratio exceeding about 10:1 and being port loadable in a range of about 5,000 BTUH per square inch to 30,000 BTUH per square inch of port area and passing a volume percentage of combustion air in a range of 0 percent to about 30 percent of a stoichiometric requirement for complete combustion of a gaseous fuel, whereby a fuel/air mixture passing through said at least one elongated port has a Froude Number in a range of about 0.05 to 4.0.

10. A gaseous fuel fireplace burner according to claim 9 wherein the burner manifold comprises a plurality of elongated ports.

11. A gaseous fuel fireplace burner according to claim 10 wherein the plurality of elongated ports form a plurality of rows of elongated ports, and the elongated ports in a respective row are positioned generally end-to-end.

12. A gaseous fuel fireplace burner according to claim 11 wherein one of the plurality of rows is positioned at a distance of less than about 1 inch from another of the plurality of rows.

13. A gaseous fuel fireplace burner according to claim 11 wherein the elongated ports of one of the rows is in a staggered relationship with the elongated ports of an adjacent row.

* * * * *